United States Patent [19]

Peng et al.

[11] Patent Number: 4,992,118

[45] Date of Patent: Feb. 12, 1991

[54] CHEMICALLY FOAMED EMULSION EXPLOSIVE COMPOSITION AND PROCESS FOR ITS PREPARATION

[75] Inventors: Zhonji Peng; Guibao Li; Shiyi Shao; Wenyuan Xu; Xiangqun Wu, all of Lan Zhou, China

[73] Assignee: Gansu Research Institution of Chemical Industry, Gansu, China

[21] Appl. No.: 488,609

[22] Filed: Mar. 2, 1990

[30] Foreign Application Priority Data

Mar. 4, 1989 [CN] China ..... 89100981.7

[51] Int. Cl.[5] ..... C06B 45/00

[52] U.S. Cl. ..... 149/2; 149/60; 149/61; 149/109.6

[58] Field of Search ..... 149/2, 60, 61, 109.6

[56] References Cited

U.S. PATENT DOCUMENTS 4,472,215 9/1984 Binet et al. ..... 149/2
4,708,753 11/1987 Forsberg ..... 149/2
4,840,687 6/1989 Forsberg ..... 149/2
4,844,756 7/1989 Forsberg ..... 149/2
4,919,178 4/1990 Riga et al. ..... 149/2

*Primary Examiner*—Stephen J. Lechert, Jr
*Attorney, Agent, or Firm*—Nixon & Vanderhye

[57] ABSTRACT

A water in oil emulsion explosive composition containing inorganic nitrate and the process for its preparation are disclosed. The composition is an explosive mixture which consists of an aqueous inorganic oxidizer salt solution as disperse phase, residual oil and additives as continuous phase, emulsion foamer as occluded bubble producing material, and span-80 as emulsifier. By adjusting the pH of disperse phase and emulsion foamer, the foaming process at elevated temperature is achieved. it is an industrial explosive and has lower production cost, excellent stability, good moisture resistance and low toxicity, and has a storage life longer than 10 months.

17 Claims, No Drawings

CHEMICALLY FOAMED EMULSION EXPLOSIVE COMPOSITION AND PROCESS FOR ITS PREPARATION

This invention relates to an emulsion explosive composition, more particularly, to an emulsion explosive composition chemically foamed by emulsion foamer and process for its preparation.

The report on "the relationship between lowest crystal precipitating point and lowest eutectic point of inorganic oxidizer salt" published at the second annual meeting of Chinese Civil Explosive 1983 by this inventor came to the conclusion that the lowest eutectic component in the same system has the lowest crystal precipitating point. It is well known that aqueous oxidizer salt solution is the foundation of preparing emulsion explosive, the mixture ratio of oxidizers (NH4NO3—NaNo3, NH4NO3—KNO3) and the water content are of great importance, their optimum mixture ratio can meet the needs of the highest effective oxygen content and lowest crystal precipitating point. This determines directly the performance of emulsion explosive, namely its detonation performance and stability. Aforementioned point of view of this inventor effectively solved the problem of mixture ratio between oxidizers and water content of emulsion explosive. Making use of aforementioned point of view, this inventor has developed ZR-type emulsion explosive. There are two models of ZR-type emulsion explosive: ZR-1 AND ZR-2. Its disperse phase is composed of NH4NO3, NaNO3 and H20 in the lowest eutectic components. Its continuous phase comprises refined petroleum products: #5 engine oil and #56 paraffin; the emulsifier is sorbitan monooleate, namely span-80; the foamer is aqueous solution of NaNo2. Sulfur powder is added to the ZR-2 type emulsion explosive to improve its detonability. The cost of ZR-type emulsion explosive composition is the lowest in comparison with other emulsion explosive composition wherein the continuous hydrocarbon fuel phase comprises refined petroleum product. Because of the inelasticity and the weakness of its oil film, the stability of ZR-type emulsion explosive is imperfect; and because of the direct preparation of the foamer from NaNO2 and water, the size and the distribution uniformity of the foamer liquid drops are also imperfect. These disadvantages may be overcome by this invention.

Yorke et al, in U.S. Pat. No. 4,404,050 (1983.9.13) disclosed an emulsion explosive composition wherein the continuous hydrocarbon fuel phase comprises an unrefined or partly refined petroleum product. He pointed out that the said unrefined or partly refined petroleum product comprises at least 10% by weight of a flowable oil if the said petroleum product is in the form of a petroleum wax or comprises at least 10% by weight of a distillation residue if the said petroleum product is in the form of a petroleum oil or ar; and he also pointed out that the component molecules have between 20 and 80 carbon atoms and less than 50% of the said molecules have a number of carbon atoms within the same five carbon atoms range. However, the low carbon molecule content of the oil phase material is quite high, so the oil film is soft and its bubble-fixing ability for occluded bubble is imperfect, though the cost of the explosive is reduced. Also if the content of the molecule having more than 40 carbon atoms in oil phase is quite high, the oil phase material is stiff, and excessively high temperature is required in presentation of the flowability of the oil phase. It is necessary to choose specific emulsifier at excessively high temperature, and common emulsifier may be of no use. Moreover, the low carbon molecules of oil phase also fail to make full use.

Although there are currently a variety of emulsion explosives for industrial use, it is necessary to make requisite improvement on various aspects of the emulsion explosive composition such as process, performance, and cost to provide new products superior in cost, stability, storage life and moisture resistance. This inventor has made various investigations for a long period of time in this field. As a result, this invention has been accomplished. Aforementioned requirements to the emulsion explosive of the invention is achieved.

The object of this invention is to provide a new type of low cost, good stability, easily preparing and operating emulsion explosive composition. Another object of this invention is to provide a new process of preparing said emulsion explosive. In said process, the conventional foaming process is changed, the distribution uniformity of foamer is improved, the cost is reduced, and the stability is increased. A further object of this invention is to provide a emulsion explosive composition which can be also used effectively at moist environment.

The above and other objects and features of this invention will appear more fully from the following description.

SUMMARY OF THE INVENTION

This invention relates to a new emulsion explosive composition comprising a disperse phase formed of an aqueous inorganic oxidizer salt solution; a continuous phase formed of a hydrocarbon fuel; emulsion foamer; and emulsifier. Said aqueous oxidizer salt solution is an aqueous solution comprising NH4NO3, NaNO3, water and urea; hydrocarbon fuel compounding from residual oil as basic material and thickener. Said residual oil is an oil-waxy material left over by extracting of light distillate and pitch from crude petroleum. Preferably, in said residual oil, over 95% of component molecules have greater than 20 carbon atoms, in which 80% of the said molecules have between 20 and 40 carbon atoms, and 35%–65% of the said molecules have between 31 and 40 carbon atoms. Preferably, the drop point of said residual oil is 40–50° C. Said emulsion foamer is preferably oil in water type emulsion containing sodium nitrite. Said emulsifier is preferably sorbitan monooleate.

This invention also relates to a process for the preparation of said emulsion explosive composition comprising:

(a) At 60–90° C., the aqueous solution of Inorganic oxidizer salt being mixed with the hydrocarbon fuel and emulsifier, and emulsified under stirring to prepare an emulsion;

(b) At 60–90° C., the aqueous solution (PH8–9) of NaNO2 being mixed with the oil phase material and emulsifier, and emulsified under stirring to prepare an emulsion foamer;

(c) AT about 70° C., the emulsion foamer being added to the emulsion, homogenized by stirring, to prepare this emulsion explosive composition of this invention.

The problems of size and distribution uniformity of sensitizing bubble of the emulsion explosive composition of this invention have been solved by the use of emulsion foamer and by the good compounding of residual oil and thickener, the oil film strength is improved, the stability is increased, the operation is more easy, and the cost is reduced.

DETAILED DESCRIPTION OF THE INVENTION

The invention relates to an emulsion explosive composition comprising a disperse phase formed of an aqueous inorganic oxidizer salt solution; a continuous phase formed of a hydrocarbon fuel and thickener; another disperse phase formed of emulsion foamer and emulsifier. Its object is that the cost of the emulsion explosive is reduced, and the stability of the emulsion explosive is increased by mean of using the lowest eutectic mixture of oxidizer salt aqueous solution as disperse phase, low-priced petroleum refining product as hydrocarbon fuel continuous phase, and changing the conventional foaming process (the emulsion foamer is used at elevated temperature).

In this invention, the lowest eutectic mixture of NH4NO3 and NaNO3 is used s basic material of the disperse phase (water phase), water is added to form oxidizer salt aqueous solution, urea is used to decrease the crystal precipiting point, and sodium borate is used to adjust the PH value of the solution to 6-7. The amounts of above materials are as follows:

NH4NO3 61.5-68% (weight)
NaNO3 15-22% (weight)
Urea 0-2% (weight)
Water 10.5-12.5% (weight)

In consideration of the great disadvantages (e.g. brittleness of the oil film, poor bubble-fixing ability, and relative dilution of the emulsion formed) involved in ZR-emulsion explosive, and in consideration of the drawbacks resulted by excessive amount of low and high carbon molecules in U.S. Pat. No. 4,404,050, the residual oil from petroleum refinery is used as basic material in continuous hydrocarbon fuel phase of the emulsion explosive composition of this invention, and ethylene propylene rubber polyethylene wax or atactic polypropylene is added as thickener. Said residual oil is an oil-waxy residual material left over by extracting of light distillate and pitch from crude petroleum. In said residual oil, over 95% of component molecules have more than 20 carbon atoms, wherein 80% of said molecules have between 20 and 40 carbon atoms and 35%-65% of said molecules have between 31 and 40 carbon atoms and the drop pint of said residual oil is 40-50° C. The viscosity of the emulsion prepared from said hydrocarbon fuel is greater than 100,000 centipoise. Owing to the use of refinery residuum in which most of the important industrial chemicals of low carbon molecules have been extracted, various ingredients of refinery product have been made full use, so the cost is reduced and the thickness is increased. The less content of high carbon molecule makes the oil film more tough and tenacious, the strength and bubble -fixing ability of oil film can both be increased, thus the stability of the said emulsion explosive be improved. In said emulsion explosive composition, the compounding amount of residual oil is generally 2-5% by weight, and preferably wax and/or atactic polypropylene is selected as thickener. The compounding amount of the thickener is generally 0.3-1.0% by weight.

Emulsion foamer (sensitizer), namely density adjusting agent must be added to emulsion explosive. It is well known that the detonability and storage stability are directly affected by the size and distribution uniformity of the sensitizing bubbles. Chemical foamer must still be used to reduce the cost for the sake of maintaining the important position of emulsion explosive in industrial explosive. However, if the aqueous solution of NaNO2 (or mixture of NaNO2 with NH4NO3) is mixed directly (cold mixing) with the emulsion of explosive, the foamer aqueous solution is difficult to be split into micron-sized liquid drops in a short time to form stable "water in oil" type dispersion by low speed shearing stirring alone since the viscosity of the emulsion will be increased at a lower temperature (below 30° C.). It is well known that the size and the distribution uniformity of foamer's liquid drops determine the size and the distribution uniformity of sensitizing bubbles in the emulsion explosive, and the size and the distribution uniformity of sensitizing bubbles will determine directly the detonability and storage stability of the emulsion explosive. Accordingly, emulsion foamer is adopted in this invention, that is to say, at first the NaNO2 aqueous solution is emulsified to solve the problem of liquid drop size of NaNO2 foamer solution, then the simple mixing (oil with oil) and foaming are carried out with the emulsion to solve the problem of the size and the distribution uniformity of sensitizing bubbles thoroughly. The compounding amount (by weight) of emulsion foamer is as follows:

NaNo2 15-25%;
water 63-70%;
residual oil 2-4%;
#5 engine oil 3-7%;
span-80 2-4%.

Method of Preparing emulsion foamer is as following:

NaNo2 is dissolved in definite amount of water at room temperature or by slight heating, the PH of resulting solution is adjusted to weak alkaline by PH adjusting agent, such as borax, sodium borate, Na2 Co3 or NaOH. The residual oil, which is same as that for the preparation of the emulsion said above, and #5 engine oil are added into emulsor under stirring and heating to 60-90° C. After complete mixing of the oil phase, emulsifier span-80 (sorbitan monooleate) is added. The aqueous solution of NaNo2 is added slowly to oil phase, and the stirring rate is speeded up over 1,000 rpm. after emulsifying, the emulsion is stirred for further 10 minutes and then cooled to room temperature, said emulsion foamer is obtained.

Although chemical foaming process is used in the preparation of emulsion explosive in this invention, the process and the distribution uniformity are controllable. This inventor found that when the aqueous solutions of NaNo2 and NH4No3 are mixed, the weak acidity or acidity of the medium is the essential condition for the bubble production. Therefore, in this invention, at first the PH of the emulsion foamer is adjusted to weak alkaline, and then the emulsion foamer is added to the emulsion formed of aqueous phase and oil phase. The goal of foaming controlling can be achieved by the above process. The specific experimental results are listed on Table 1. (the emulsion explosive composition of Example 5 as the test sample)

TABLE 1

| order No. | PH of foamer emulsion | PH adjusting agent | foamer adding temp. °C. | foaming temp. °C. | foaming condition ($g/cm^3/hr.$) | |
|---|---|---|---|---|---|---|
| 1 | PH of NaNo2 aq. soln. | | 55 | 49–50 | density 1.06/5 hr | foaming quickly |
| 2 | 7 | sodium borate | 70 | 49–51 | density 1.18/2 hr | foaming quickly |
| 3 | 9 | sodium borate | 70 | 49–51 | density 1.18/4 hr | foaming quickly |

We can find out from Table 1 that the different PH values of the emulsion foamer cause the different foaming times, and the foamer adding at elevated temperature can always promote the foaming more quickly. For this reason, the following experiments were carried out. The experimental results are listed on Table 2 and the amounts of the materials used therein is expressed in % by weight. (the emulsion explosive composition of Example 5 as the test sample).

TABLE 2

| | water phase | | emulsion foamer | | foamer adding temperature | | results | |
|---|---|---|---|---|---|---|---|---|
| order No. | sodium borate (%) | PH | amount (%) | PH | began °C. | end °C. | apparent foaming time | density/foaming time |
| 1 | 0.2 | 6.4–6.7 | 0.15 | 9 | 85 | 75 | foaming quickly | 1.12/4.40'<br>1.11/6.20' |
| 2 | 0.2 | 6.4–6.7 | 0.15 | 9 | 63 | 54 | ½ hr | 1.15/4.30'<br>1.15/6.45' |
| 3 | 0.4 | 6.7 | 0.15 | 9 | 86 | | 1 hr. 55 min. | 1.20/5.45'<br>1.23/9.45' |
| 4 | 0.4 | 6.7 | 0.15 | 9 | 65 | 58 | 2 hr | 1.27/5.30'<br>1.20/9.30' |
| 5 | 0.3 | 6.4–6.7 | 0.15 | 9 | 80 | | ½ hr | 1.09/3.40'<br>1.18/5 hr |
| 6 | 0.3 | 6.4–6.7 | 0.15 | 9 | 65 | 51 | 1 hr | 1.25/3.25'<br>1.20/4.50' |

From Table 2 we can find out the relationship between different PH values of water phase and of emulsion foamer and foaming results. In Table 2, sodium borate is added to water phase to adjust the PH to 6.4–6.7 and also added to foamer to adjust the PH to 9. At this condition, no bubble evolves by adding of emulsifier, even though the temperature of the emulsion is up to 70° C.

This inventor, upon the optimum results obtained in experiments, adjusted the PH of the water phase to nearly neutral and the PH of the emulsion foamer to weak alkaline. Under these conditions no bubble evolved upon adding the emulsifier even though the temperature of the emulsion was near 70° C. Only after the emulsion foamer is mixed with the emulsion, and the foamer is neutralized to weak acidic with NH4NO3 in the water phase, can the chemical foamer be foamed, and can cause the bubbles to effect the density adjusting agent of the emulsion explosive.

To sum up, the preferred process of preparing the emulsion explosive of this invention comprises a chemical foaming process in which said foamer is added into the emulsion and foams at 50–55° C. The present invention is characterized in that the emulsion foamer is used at an elevated temperature. At first, aqueous NaNo2 solution is adjusted to weak alkaline (PH–9). An emulsifier is then added to produce an emulsion foamer with the aqueous NaNo2 solution as a disperse phase and hydrocarbon fuel as a continuous phase.

In order to prepare the emulsion explosive, the PH of the water phase oxidizer salt aqueous solution is first adjusted to near neutral, and the oil phase material is then added to form the emulsion. The emulsion foamer is added at the emulsion temperature at about 70° C. The adoption of emulsion foamer in this invention produces a disperse phase aqueous NaNo2 solution coated with a continuous phase oil film. In one aspect, the emulsion foamer is dispersed uniformly in the emulsion; in the other aspect, the rapid contacting of a larger quantity of $NaNo_2$ with $NH_4NO_3$ can be avoided.

Thus the production rate of gas bubbles can be reduced and the emulsion foamer can be added to the emulsion without ever foaming, even at elevated temperature (~70° C.). Thus, the emulsion cooling process can be omitted and favorable conditions for continuous production of emulsion explosive are created.

In this invention sorbitan monooleate (span-80) which is commonly used in known emulsion explosive is the preferred emulsifier.

The preferred quantities of ingredients in the emulsion explosive composition of this invention are as follows: (% by weight)

| | |
|---|---|
| Ammonium nitrate | 61.5–68% |
| Sodium nitrate | 15–20% |
| urea | 0–2% |
| water | 10.5–12.5% |
| residual oil | 3.3–4.5% |
| thickener | 0.3–1.0% |
| span-80 | 1.2–1.8% |
| emulsion foamer | 0.1–0.3% |

The pH of the aqueous solution is adjusted to near neutral by the addition of 0.3% by weight of Sodium borate.

Therefore, the process for preparing the emulsion explosive of this invention is: Oxidizer salts and water are added to the dissolving tank, urea is then dissolved at a temperature of 60–90° C. (depending on the crystal-precipitating temperature), lasting a pH adjusting agent (sodium borate) is added. The oil phase material is added to the emulsor. The preferred temperature of the oil phase is equal to that of the water phase. When the oil phase is melted completely, the emulsifier is added.

Then the water phase solution is added slowly from the dissolving tank to the emulsor. When the addition of aqueous solution is completed, the stirring rate is speeded up over 1,000 rpm. After emulsifying for 10 min, the emulsion is cold down to about 70° C. Then the emulsion foamer is added. When the mixing is completed, stop the stirring and hand to charge. Then the cartridge is placed in the foaming chamber, and foams for 4 hr. at 50–55° C. Then the resulting emulsion explosive can be boxed.

In addition to the properties such as free from any explosive component, detonable directly with #8 blasting cap in small diameter cartridge, safety in storage and transportation, and good detonability, as the same kind of products, the emulsion explosive composition of this invention also have the advantages of lower cost, good stability and good water-resistance. So it will be one type of civil explosive which has encouraging prospects.

The effectiveness of this invention will be explained further in detail in the following examples and data (GX represents the emulsion explosive of this invention).

EXAMPLES 1–12

The emulsion explosive compositions, according to the ingredients shown in Table 3 (% by weight) wherein the examples 1–4 belong to ZR-type emulsion explosive and the examples 5–12 belong to GX-type emulsion explosive of the present invention, were prepared.

TABLE 3

| | order No. | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Ammonium Nitrate | 63.8 | 65.3 | 63.7 | 63.5 | 64.4 | 62.8 | 65.0 | 61.5 | 66.5 | 67.5 | 68.0 | 64.8 |
| Sodium Nitrate | 15.9 | 16.3 | 15.9 | 16.0 | 16.1 | 15.7 | 16.2 | 19.2 | 15.0 | 15.0 | 15.0 | 16.2 |
| Water | 12.0 | 12.1 | 12.0 | 12.0 | 12.5 | 12.1 | 11.5 | 10.5 | 11.5 | 10.5 | 10.5 | 12.0 |
| Urea | 1.9 | | | 2.0 | 0.5 | 0.5 | 1.0 | 2.0 | 1.0 | 1.0 | 1.0 | |
| residual oil* | | | | | 4.1 | 4.1 | 4.2 | 4.5 | 3.3 | 3.5 | 3.7 | 4.2 |
| 5# engine oil | 1.5 | 2.0 | 1.8 | 1.5 | | | | | | | | |
| 56# paraffin | 1.5 | 2.8 | 2.4 | 1.4 | | | | | | | | |
| earth wax | 1.3 | | | 1.0 | | | | | | | | |
| span 80 | 1.5 | 1.5 | 1.5 | 1.5 | 1.5 | 1.4 | 1.5 | 1.8 | 1.2 | 1.7 | 1.5 | 1.5 |
| ethylene propylene rubber | | | | 0.3 | 0.5 | 0.5 | 0.5 | 0.3 | 0.5 | 0.5 | 0.3 | 0.5 |
| Aluminum stearate | 0.2 | | | 0.2 | | | | | | | | |
| lecithin | 0.2 | | | | 0.3 | 0.3 | | | | | | 0.3 |
| sulfur Powder | | | 2.6 | | | | | | | | | |
| foamer | 0.15 | 0.15 | 0.15 | 0.15 | 0.15 | 0.15 | 0.15 | 0.3 | 0.15 | 0.3 | 0.3 | 0.15 |
| storage life | 120 day | 87 day | 87 day | 89 day | | | | >10 months | | | | |

*Residual oil from Lanzhou Refinery or Yumen Refinery.

The compounding amounts of the foamers in examples 5 to 12 are respectively as follows (% by weight):

| | Example | | | | | | | |
|---|---|---|---|---|---|---|---|---|
| | 5 | 6 | 7 | 8 | 9 | 10 | 11 | 12 |
| sodium nitrite | 25% | 20% | 20% | 17% | 25% | 15% | 17% | 20% |
| water | 63% | 70% | 7% | 70% | 63% | 70% | 70% | 7% |
| residual oil | 2% | 2% | 4% | 4% | 2% | 4% | 4% | 2% |
| #5 engine oil | 7% | 5% | 3% | 7% | 7% | 7% | 7% | 5% |
| span-80 | 3% | 3% | 3% | 2% | 3% | 4% | 2% | 3% |

Method of preparing the emulsion foamers in GX-type emulsion explosive compositions of examples 5–12 is as following:

Sodium nitrite is dissolved in definite amount of water at room temperature or by slight heating; the PH value of the resulting aqueous solution is adjusted to pH 8–9 by borax. The residual oil from Lanzhou or Yumen Refinery and #5 engine oil are added to emulsor under stirring and heating to 60–90° C. When the oil phase has been mixed completely, span-80 is added. The compounded sodium nitrite aqueous solution is then added slowly to the oil phase, the stirring rate is speeded up over 1,000 rpm. Stirring for 10 min. after emulsified, then cooled to room temperature, the resulting emulsion foamer is obtained.

The foamer used in ZR-type emulsion explosive composition (examples 1–4) is the saturated aqueous solution of sodium nitrite.

The emulsion explosive composition of each example is compounded of said foamer obtained and the components listed in Table 3. The preparing method is as following:

Method of preparing the emulsion explosive compositions of examples 1 to 4:

$NH_4No_3$, $NaNo_3$, urea and water are added into the dissolving tank and dissolved completely under stirring and heating to 60° to 85° C. engine oil, paraffin and earth wax are added into an emulsor under stirring and heating to 60–85° C. After the oil phase is melted, span-80, Aluminum stearate and lecithin are added. The water phase solution is add slowly form the dissolving tank to the emulsor under stirring speeded up to 1,000 rpm. After emulsified for 10 min, the temperature is reduced to 30° C. or less and saturated aqueous solution of sodium nitrite is added under stirring. Then sulfur powder is added under stirring. After mixing completely, hand to charge and foaming for 4 hr, the resulted emulsion explosive is boxed.

Method of preparing the emulsion explosive of examples 5–12:

Oxidizer salt $NH_4No_3$ and $NaNo_3$ and water are added to the dissolving tank, urea is then dissolved in at 60–90° C. (depending on the crystal-precipitating temperature), sodium borate is at last added to adjust the pH of the solution. The oil phase materials (residual oil, thickener) are added to the emulsor, the preferred temperature of the oil phase is equal to that of the water phase. After the oil phase is melted, the emulsifier is added. The water phase solution is added showly from the dissolving tank to the emulsor. When the addition of aqueous solution is completed, the stirring rate is speeded up over 1,000 rpm. After emulsifying, cool the emulsion to about 70° C., emulsion foamer obtained is added. After mixing completely, stop stirring, hand to charge, the cartridge obtained is placed in the foaming chamber where the temperature is 50–55° C. Foaming for 4 hr, the resulting emulsion explosive is boxed.

Now, the needle penetration, the density change at decompression, and the storage experiment carried out at Lanzhou area of GX-type emulsion explosive and ZR-type emulsion explosive are evaluated, by which the good stability of GX-type emulsion explosive is indicated. The waterresistance is evaluated by the water resistance test. The practical test method is as following:

PERFORMANCE TEST 1

Needle Penetration Test

According to National standard of People's Republic of China GB 269-77, the ZR-1, ZR-2 and GX-type emulsion explosive of example 11 are subjected to needle penetration test. The practical method is as following:

The test is carried out on a penetrometer. Penetration is expressed as the depth that a standard cone vertically sinks into the sample within 5 seconds. The unit of penetration is 0.1 mm.

The test results are listed on Table 4.

TABLE 4

| | Product | | |
|---|---|---|---|
| | ZR-1 (example 1) | ZR-2 (example 2) | GX (example 11) |
| Penetration | 236 | 240 | 170 |

As shown on table 4, the penetration of GX emulsion explosive is smaller than that of ZR-1 and ZR-2, which is considered as the oil film of GX-type emulsion explosive has an improved strength. So the stability of GX-type emulsion explosive of the invention is better.

PERFORMANCE TEST 2

Density Change at Decompression

Density change of GX-type explosive is determined for several times at decompression. The determination method is as following. GX-type explosive is decompressed by water pump in a vacuum oven at room temperature, the gage pressure raises within 1 hr from 0 mm Hg to 500 mm Hg (most of the time is 380–400 mm Hg). The specific data are listed on Table 5 (GX-type emulsion explosive of example 11 is used as the test samples).

TABLE 5

| | order No | | |
|---|---|---|---|
| | 1 | 2 | 3 |
| density $\rho$ before decompres. | 1.11 | 1.15 | 1.15 |
| density $\rho$ after decompres. | 1.25 | 1.26 | 1.18 |

The data on Table 5 indicate that the average increase of GX-type explosive's density is 0.14–0.11 g/cm$^3$, unchange case is only unique. But the blasting cap sensitivity of ZR explosive was soon lost after decompression. The data also indicate that the bubble-fixing ability of GX-type explosive is strong. This undoubtedly ensured its good stability.

PERFORMANCE TEST 3

Water REsistance Test

Nude cartridge, after maintaining storage for 6 hr under 8 kg/cm$^2$ of water pressure, still be capable of reliably detonated (under water pressure) by #8 blasting cap.

PERFORMANCE TEST 4

Storage Test

Actual storage life at Lanzhou area of different composition of ZR-and GX-type emulsion explosives are listed on Table 3 wherein the examples 1–4 are ZR-type emulsion explosive. In order to elongate its storage life, the thickener, stabilizer, and crystal-precipitating decreasing agent are added. But the longest storage life is only 120 days (including the summer season); the examples 5–12 are GX-type emulsion explosive, their storage life are all greater than 10 months. Their performances fully satisfy the operating requirement.

Besides above performance tests, the production costs of GX- and ZR-type explosives are compared. In addition to the simplified process technology, the raw material cost of GX is notably low. The specific data are listed on Tab 6 (unit: /ton).

TABLE 6

| product | water phase | oil phase | extra component | package | total |
|---|---|---|---|---|---|
| ZR-1 (example 1) | 339.68 | 179.2 | 1.287 | 140 | 660.16 |
| ZR-2 (example 3) | 331.36 | 171.72 | 287.29 | 140 | 930.37 |
| GX (example 7) | 338.76 | 159.7 | 3.77 | 140 | 642.23 |

What we claim is:

1. An emulsion explosive composition comprising a disperse phase formed of an aqueous inorganic oxidizer salt solution, a continuous phase formed of a hydrocarbon fuel and emulsifier with emulsion foamer, wherein said aqueous oxidizer salt solution comprises an aqueous salt solution of ammonium nitrate, sodium nitrate, and water and urea, said hydrocarbon fuel is compounded from residual oil (as basic material and thickener, said residual oil is an oil-waxy material left over by extracting light distillate and pitch from crude petroleum, and said emulsion foamer is an oil in water emulsion containing sodium nitrite.

2. An emulsion explosive composition as claimed in claim 1 wherein said residual oil is an oil waxy material in which over 95% of component molecules have greater than 20 carbon atoms, wherein 80% of said molecules have between 20 and 40 carbon atoms and 35–65% of said molecules have between 31 and 40 carbon atoms; and the drop point of said residual oil is 40–50° C.

3. An emulsion explosive composition as claimed in claim 1 wherein the amount of said residual oil is 2–5% by weight.

4. An emulsion explosive composition as claimed in claim 1 wherein said emulsion foamer comprises 15–25% by weight of sodium nitrite, 63–70% by weight of water, 2–4% by weight of residual oil, 3–7% by weight of #5 engine oil and 2–4% by weight of sorbitan monooleate emulsifier.

5. An emulsion explosive composition as claimed in claim 1 wherein said thickener is selected from ethylene propylene rubber, polyethylene wax and atactic polypropylene and mixtures thereof, the amount of said thickener is 0.3–1.0% by weight.

6. An emulsion explosive composition as claimed in claim 1, which comprises 55–66% by weight of ammonium nitrate, 15–20% by weight of sodium nitrate, 0.5–2% by weight of urea, 9–12.5% by weight of water, 3–5% by weight of residual oil, 0.3–1.0% by weight of thickener, 1.2–1.8% by weight of sorbitan monooleate emulsifier and 0.1–0.3% by weight of emulsion foamer.

7. An emulsion explosive composition claimed in claim 6 wherein said emulsion foamer comprises 15–25% by weight of sodium nitrite, 63–70% by weight of water, 2–4% by weight of residual oil, 3–7% by weight of #5 engine oil and 2–4% by weight of sorbitan monooleate emulsifier.

8. A process for the preparation of the emulsion explosive of claim 1 which comprises:

(a) At 60–90° C., the aqueous solution of inorganic oxidizer salt being mixed with the hydrocarbon fuel in the presence of emulsifier, and emulsified under stirring to prepare an emulsion;

(b) AT 60–90° C., the aqueous solution (pH 8–9) of sodium nitrite being mixed with the oil phase material in the presence of emulsifier, and emulsified under stirring to prepare an emulsion foamer;

(c) At about 70° C., the emulsion foamer being added to the emulsion, homogenized by stirring, and foaming at 50–55° C., to prepare said emulsion explosive composition.

9. A process as claimed in claim 8 wherein said aqueous inorganic oxidizer salt solution is an aqueous solution comprising ammonium nitrate, sodium nitrate and water, and urea, said hydrocarbon fuel is compounded from residual oil (as basic material) and thickener, said residual oil is an oil-waxy material left over by extracting light distillate and pitch from crude petroleum, said oil phase materials of emulsion foamer comprises residual oil and #5 engine oil, said emulsifier is sorbitan monooleate.

10. A process as claimed in claim 9 wherein said residual oil is an oil waxy material in which over 95% of component molecules have greater than 20 carbon atoms, wherein 80% of said molecules have between 20 and 40 carbon atoms, and 35–65% of said molecules have between 31 and 40 carbon atoms, and the drop point of said residual oil is 40–50° C.

11. A process as claimed in claim 9 wherein the amount of residual oil is 2–5% by weight.

12. A process as claimed in claim 8 wherein said emulsion foamer comprises 15–25% by weight of sodium nitrite, 63–70% by weight of water, 2–4% by weight of residual oil, 3–7% by weight of #5 engine oil and 2–4% by weight of sorbitan monooleate emulsifier.

13. A process as claimed in claim 8 wherein said thickener is selected from ethylene propylene rubber. polyethylene wax and atactic polypropylene and mixtures thereof, the amount of said thickener is 0.3–1.0% by weight.

14. A process as claimed in claim 9 wherein the amount of ammonium nitrate is 55–68% by weight, the amount of sodium nitrate is 15–20% by weight, the amount of urea is 0.5–2% by weight, the amount of water is 9–12.5% by weight, the amount of residual oil is 3–5% by weight, the amount of thickener is 0.3–1.0% by weight, the amount of sorbitan monooleate emulsifier is 1.2–1.8% by weight, the amount emulsion foamer is 0.1–0.3% by weight.

15. A process as claimed in claim 14 wherein said emulsion foamer comprises 15–25% by weight of sodium nitrite, 63–70% by weight of water, 2–4% by weight of residual oil, 3–7% by weight of #5 engine oil, and 2–4% by weight of sorbitan monooleate emulsifier.

16. A process as claimed in claim 8 wherein the PH value is adjusted by the PH adjusting agent selected from borax, sodium borate, sodium carbonate or sodium hydroxide.

17. An emulsion explosive composition as claimed in claim 2 wherein the amount of said residual oil is 2–5% by weight.

* * * * *

UNITED STATES PATENT AND TRADEMARK OFFICE

CERTIFICATE OF CORRECTION

PATENT NO. : 4,992,118

DATED : February 12, 1991

INVENTOR(S) : PENG et al

It is certified that error appears in the above-identified patent and that said Letters Patent is hereby corrected as shown below:

Column 2, lines 48-49, delete "oil in water" insert --water in oil--.

Column 7, line 58, in the table for Examples 7 and 12, delete "7%" insert --70%-- (both occurrences).

Column 10, line 45, add a close parenthesis --)-- after "material";

line 48, delete "an oil in water" insert --a water in oil--.

Signed and Sealed this

Twelfth Day of October, 1993

Bruce Lehman

*Attest:*

BRUCE LEHMAN

*Attesting Officer*

*Commissioner of Patents and Trademarks*